US006158908A

United States Patent [19]

Yuge

[11] Patent Number: 6,158,908

[45] Date of Patent: Dec. 12, 2000

[54] HEAD DRIVE MECHANISM

[75] Inventor: Tomohiko Yuge, Mobara, Japan

[73] Assignee: Futaba Denshi Kogyo Kabushiki Kaisha, Mobara, Japan

[21] Appl. No.: 09/392,719

[22] Filed: Sep. 9, 1999

[30] Foreign Application Priority Data

Sep. 14, 1998 [JP] Japan ..... 10-259605

[51] Int. Cl.[7] ..... B41J 19/30

[52] U.S. Cl. ..... 400/320; 400/332

[58] Field of Search ..... 400/320, 332, 400/332.6, 352, 354

[56] References Cited

U.S. PATENT DOCUMENTS 4,784,503 11/1988 Bettini ..... 400/320
5,465,110 11/1995 Carlotta et al. ..... 347/104
5,832,820 11/1998 Barrus ..... 101/93.04

*Primary Examiner*—John S. Hilten
*Assistant Examiner*—Darius Cone
*Attorney, Agent, or Firm*—Oblon, Spivak, McClelland, Maier & Neustadt, P.C.

[57] ABSTRACT

A head drive mechanism capable of improving color shading in an exposed image due to a variation or nonuniformity in speed of a photosensitive head corresponding to pitches of teeth of a toothed belt. The photosensitive head includes a dot block which is constituted by a luminous dot group constituted of a line of a row A formed of even luminous dots and a line of a row B formed of odd luminous dots. Also, the rows A and B are so arranged that the luminous dots of the row A and those of the row B are offset from each other with an interval Ds being defined therebetween. A final transmission system is constituted of a toothed drive pulley, a toothed driven pulley and a toothed belt. The toothed belt is constructed so as to have tooth pitches Q=2Ds/(2n+1) reduced in terms of a relative travel distance of the head, wherein n is 0 or a positive integer.

1 Claim, 9 Drawing Sheets

HEAD DRIVE MECHANISM

BACKGROUND OF THE INVENTION

This invention relates to a head drive mechanism, and more particularly to a drive mechanism for driving a write head for a printer or the like.

A conventional optical printer in which a phosphor head, an LED head or the like is incorporated is generally constructed in such a manner that a printer head is linearly moved to carry out optical writing on a photosensitive paper. Also, in an ink jet printer and a thermal printer as well, a printer head is linearly moved with respect to a recording paper to carry out recording thereon.

Now, a conventional head drive mechanism for such a printer will be described with reference to FIGS. 7 and 8, wherein FIG. 7 is a perspective view showing such a head drive mechanism and FIG. 8 is a schematic view showing a transmission system for transferring a head by means of a wire rope.

In FIG. 7, reference numeral 51 designates a housing 51 for a printer, of which a part is broken away for the sake of brevity. The housing 51 is provided therein with two shafts 53, which are supported at both ends thereof through supports 52 in the housing 51. The housing 51 is also provided therein with a base 63, which is provided at each of both ends thereof with a bearing 54, through which the base 63 is slidably supported on the guide shafts 53.

The housing 51 is so constructed that a photosensitive paper (not shown) is arranged on an upper surface of the housing 51 while keeping a photosensitive surface thereof facing down.

Reference numeral 64 designates a photosensitive head, which is mounted on base 63. The photosensitive head 64 is constructed in the form of an optical writing module. The photosensitive head 64 is formed thereon with a dot block 64*a* which acts to carry out optical writing on the photosensitive surface of the photosensitive paper. The dot block 64*a* has a plurality of luminous dots arranged in an offset manner so as to form recording dots. The luminous dots each are constructed so as to emit light of luminance defined depending on a drive signal fed thereto from a drive signal generation section (not shown).

The photosensitive head 64 is constructed so as to travel at a constant speed along the guide shafts 53 by means of a transmission system described hereinafter. Unfortunately, a travel speed of the photosensitive head 64 is often cyclically varied depending on mechanical accuracy of a power drive system. Such a variation tends to cause color shading in an image exposed by the photosensitive head 64.

In view of such a problem, the assignee proposed techniques which permit color shading due to a variation in a travel speed of the photosensitive head 64 to be effectively restrained by suitably setting relationship between an interval Ds between luminous dot rows arranged in an offset manner and a reduction ratio of a drive system for transferring the photosensitive head 64, as disclosed in Japanese Patent Application No.67523/1996.

Now, the drive system disclosed in the Japanese application described above will be described with reference to FIG. 8. The drive system includes a motor 56 mounted on a motor mounting plate 55 fixed to the housing 51 shown in FIG. 7. The motor 56 includes an output shaft 56*a,* on which a drive pulley 57 is fixed. Also, the housing 51 is mounted therein with a pulley mounting support 60, which is then mounted thereon with a tension adjusting lever 61.

The drive system also includes a driven pulley 59, as well as a wire rope 58 which is arranged so as to extend between the drive pulley 57 and the driven pulley 59 while being wound thereon. The wire rope 58 has both ends caulked together by means of a fitment 58*a,* resulting in being in the form of an endless belt. The wire rope 58 is fixed to the base 63 through the fitment 58*a*. The photosensitive head 64 mounted on the base 63 is fixed to the base 63 so as to be moved in association with the wire rope 58.

Actually, the wire rope 58 is wound on the drive pulley 57 plural times, resulting in preventing slippage between the drive pulley 57 and the wire rope 58.

The tension adjusting lever 61 is fixedly mounted on one end thereof with a shaft 61*a,* which is supported on the pulley mounting support 60 in a manner to be pivotally movable. The tension adjusting lever 61 is mounted on a central portion thereof with a support shaft 61*c* by caulking, to thereby rotatably support the pulley 59 thereon. The tension adjusting level 61 is formed at the other end thereof with a hole in which a spring 61*b* is engagedly held at one end thereof. The spring 61*b* is heldly engaged at the other end thereof with the tension adjusting screw 62 to rotate the tension adjusting screw 62, to thereby adjust tension of the wire rope 58.

Rotation of the motor 56 permits turning force of the motor 56 to be transmitted through a reduction gear (not shown) to the drive pulley 57, leading to rotation of the drive pulley 57. Such rotation of the drive pulley 57 is transmitted to the wire rope 58 to drive it, to thereby slide the base 63 along the guide shafts 53 in directions indicated at arrows in FIG. 7, resulting in the photosensitive head 64 on the base 63 being likewise slid in the directions of the arrows or a scan direction thereof.

The drive system employs a wire drive system including the drive pulley 57 and wire rope 58 arranged at a final stage of the power transmission for transferring the head in the scan direction, to thereby eliminate nonuniform rotation of the reduction gar and drive pulley 57, resulting in ensuring traveling of the head at a uniform speed.

Unfortunately, the wire drive system constructed so as to ensure smooth power transmission has such a disadvantage as described hereinafter.

More specifically, it requires operation of subjecting both ends of the wire rope to caulking to render the rope endless. Also, it needs to wind the wire rope on the drive pulley plural times during assembling of the drive system, to thereby prevent slippage of the wire rope on the drive pulley. Thus, the drive system causes a deterioration in workability. Further, a reduction in diameter of the drive pulley for small-sizing of the printer requires to use a thin wire in view of restriction on an allowable bending radius of the wire. Unfortunately, this causes the wire to tend to have a bending propensity, leading to a further deterioration in workability.

In addition, in order to ensure that the pulley exhibits increased durability, the wire rope must be coated with nylon. To this end, careful attention must be paid to keep the coating from being damaged during assembling of the drive system, so that workability in the assembling may be further deteriorated.

Also, when the printer is constructed into a portable type, the head drive mechanism is required to be constructed so that the photosensitive head is moved in a vertical direction as well. Unfortunately, this causes load to be increased as compared with horizontal movement, so that slippage tends to occur between the drive pulley and the wire rope. In order to avoid such a disadvantage, it is needed to arrange a motor increased in output and increase both tension of the wire rope and the number of turns of the wire rope on the drive pulley, to thereby increase slip torque. However, this renders assembling of the printer highly troublesome and increases the number of steps in the assembling, leading to an increase in manufacturing cost.

In view of the foregoing, it would be considered to employ such a toothed belt as incorporated in a miniature precision machine. Such a toothed belt generally goes by the name of a timing belt in the art. Unfortunately, incorporation of such a toothed belt in the printer causes an important problem. More particularly, traveling of the toothed belt often causes a variation or nonuniformity in travel speed of the toothed belt wherein time required for the toothed belt to travel by a distance corresponding to an interval or pitch between each adjacent two teeth of the toothed belt constitutes a cycle. Such a phenomenon would be due to flexibility of the toothed belt.

Such a toothed belt is constructed in such a manner as shown in FIG. 9. The toothed belt designated at reference numeral 70 is wound on a toothed pulley 71. The toothed belt 70 is constructed by integrally forming a flat belt material with teeth 70*a* at predetermined pitches P. The flat belt member has a core which is made of a glass fiber incorporated therein to exhibit satisfactory tensile strength and regulate elongation of the belt in a prescribed standard. Also, the flat belt member is constructed so as to exhibit flexibility sufficient to permit it to be satisfactorily wound on the toothed pulley 71.

Transmission of rotation of the toothed pulley 71 to the toothed belt 70 is mainly carried out by contact between side surfaces of each of the teeth 70*a* of the toothed belt 70 and those of each of teeth 71*a* of the toothed pulley 71. The transmission is also carried out by friction due to abutment of an inner surface 70*b* of a flat belt portion (or a portion of the flat belt member defined between each adjacent two teeth 70*a* of the toothed belt 70) against an arcuate portion of an addendum of each of the teeth of the toothed pulley 71.

The teeth of the toothed belt 70 and toothed pulley 71 are formed into a reduced thickness, to thereby cause a gap between the tooth of the toothed belt 70 and that of the toothed pulley 71 to be increased when the toothed belt 70 is wound on the toothed pulley 71.

Further, in order to prevent vibration of the toothed belt 70 during operation of the printer and ensure conformability between the toothed belt 70 and the toothed pulley 71, it is desired that initial tension is applied to the toothed belt 70. However, in order to reduce loss during power transmission, actually the toothed belt 70 is typically operated while keeping initial tension at a sufficient level from being applied thereto when it is microminiaturized. This fails to permit the flat belt portion and tooth of the toothed belt to be fully bent into an arcuate shape to conform to the toothed pulley, as indicated at reference character A in FIG. 9. Rather, the flat belt portion decreased in thickness tends to be bent into a dogleg-like shape as indicated at B and the tooth tends to be kept flat as indicated at C. As a result, the flat belt portion is increased in length or width as compared with a length of the arcuate portion of the tooth of the toothed pulley 71 and the tooth of the toothed belt 70 is reduced in length or width as compared with that of a recessed portion of the toothed pulley defined between each adjacent two teeth of the toothed pulley.

This causes the toothed belt 70 to fail to travel at a uniform speed in spite of rotation of the toothed pulley 71 at a uniform speed. Such a variation or nonuniformity in travel speed of the toothed belt repeatedly occurs for every tooth, leading to color shading on a printed image.

SUMMARY OF THE INVENTION

The present invention has been made in view of the foregoing disadvantage of the prior art.

Accordingly, it is an object of the present invention to provide a head drive mechanism which is capable of eliminating color shading on an image due to a variation or nonuniformity in travel speed of toothed belt.

It is another object of the present invention to provide a head drive mechanism which is capable of eliminating a deterioration in workability.

It is a further object of the present invention to provide a head drive mechanism which is capable of facilitating transfer of a head module in a vertical direction and reducing a manufacturing cost.

In accordance with the present invention, a head drive mechanism is provided. The head drive mechanism includes a head including a plurality of recording dots arranged at predetermined intervals. The recording dots are arranged in the form of lines spaced from each other at a predetermined interval Ds in a scan direction of a recording medium. The head drive mechanism also includes a drive section for driving the head relatively to the recording medium and a transmission system for transmitting power from the drive section to the head. The transmission system includes a final transmission system constituted of a toothed pulley and a toothed belt. The toothed belt has tooth pitches $Q=2Ds/(2n+1)$ reduced in terms of a relative travel distance of the head, wherein n is 0 or a positive integer.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, a head drive mechanism for a printer according to the present invention will be described with reference to FIGS. 1 to 8.

Figure 1:
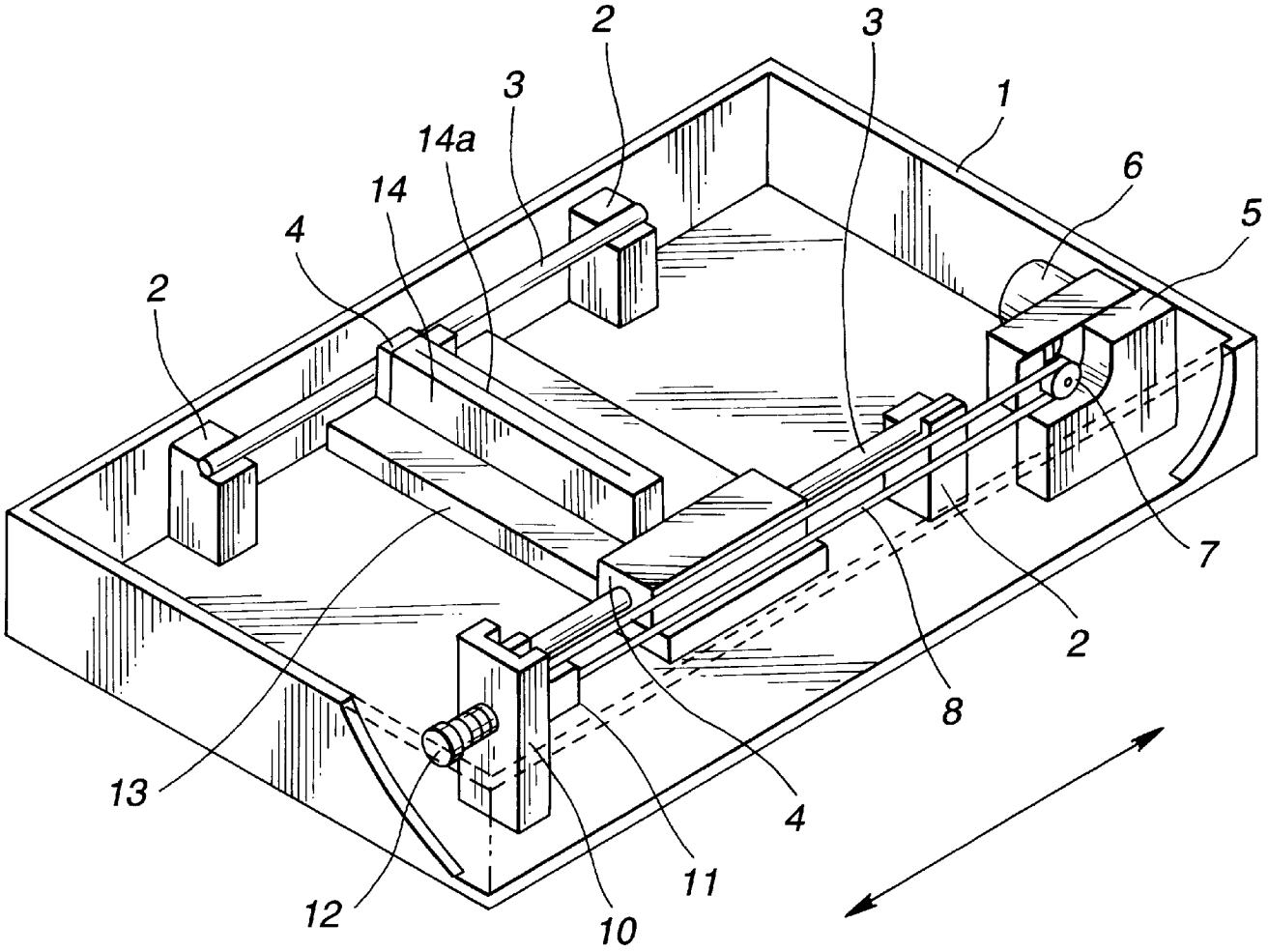
FIG. 1 is a perspective view showing a printer in which a head drive mechanism according to the present invention is mounted.
Figure 2:
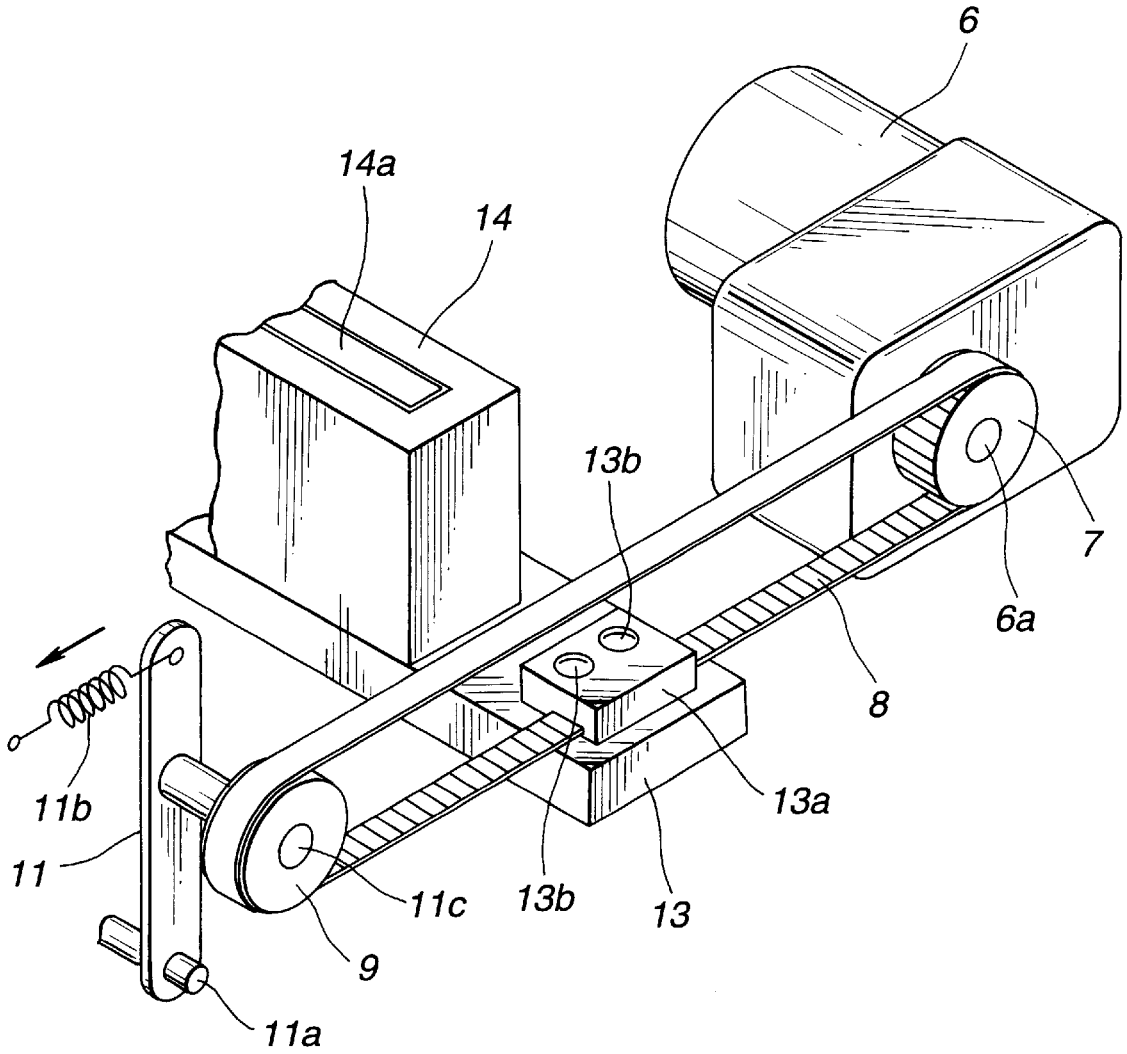
FIG. 2 is a perspective view showing a transmission system for the printer of FIG. 1.

Referring first to FIGS. 1 and 2, an embodiment of a drive mechanism for a printer head according to the present invention is illustrated.

A printer to which a head drive mechanism of the illustrated embodiment is applied includes a housing 1, of which a front section is partially cut away for the sake of brevity. The housing 1 is provided therein with two guide shafts 3 while being fixed at both ends thereof to the housing through supports 2. A base 13 is formed on both ends thereof with two bearings 4, through which the base 13 slidably supported on the guide shafts 3. The housing 51 is so constructed that a photosensitive paper (not shown) is arranged on an upper surface of the housing 51 while keeping a photosensitive surface thereof facing down, so that an image on the paper is exposed for printing through a photosensitive head 14 described below.

The photosensitive head 14 is constructed in the form of an optical write module and mounted on the base 13. The photosensitive head 14 is formed with a dot block 14*a* which functions to carry out optical writing on a photosensitive surface of the photosensitive paper. The dot block 14*a,* as described hereinafter, has a plurality of luminous dots which form recording dots arranged in an offset or staggered manner. The luminous dots are adapted to emit light for every line while exhibiting luminance depending on a drive signal fed thereto from a drive signal generation section (not shown).

Now, a drive system of the head drive mechanism of the illustrated embodiment will be described with reference to FIG. 2. The drive system includes a motor 6 mounted on a motor mounting plate 5 fixed to the housing 1 and having a reduction mechanism incorporated therein. The motor 6 includes an output shaft 6*a,* on which a toothed pulley 7 for driving is fixed. The drive system also includes a tension adjusting lever 11 mounted on a toothed pulley mounting support 10 fixed to the housing 1.

The drive system also includes a toothed belt 8 which is arranged so as to extend between the toothed drive pulley 7 and a toothed driven pulley 9 while being wound on both pulleys 7 and 9. The toothed belt 8 is fixed at a portion thereof to the base 13 by means of a fixing plate 13*a* and screws 13*b,* so that the photosensitive head 14 mounted on the base 13 may be moved at the entirely same speed as the toothed belt 8. The motor 6, as described above, has the reduction gear mechanism incorporated therein, thus, in the illustrated embodiment, the toothed belt and toothed pulleys cooperate with each other to constitute a final transmission stage.

The tension adjusting lever 11 has a shaft 11*a* fixed on one end thereof. The shaft 11*a* is pivotally supported on the toothed pulley mounting support 10. The tension adjusting lever 11 has a support shaft 11*c* mounted on a central portion thereof by caulking, on which the toothed driven pulley 9 is rotatably supported. The tension adjusting lever 11 is formed on the other end thereof with a hole, in which a spring 11*b* is engagedly held at one end thereof. The spring 11*b* is engagedly held at the other end thereof on a distal end of the tension adjusting screw 12, so that the tension adjusting screw 12 may be rotated to adjust tension of the toothed belt 8.

Thus, rotation of the motor 6 permits the base 13 to be slid along the guide shafts 3 in directions indicated by arrows in FIG. 1 through the toothed drive pulley 7 and toothed belt 8. This permits the photosensitive head 14 on the base 13 to be likewise moved in the arrow directions or a scan direction of the head.

As in the prior art described above, a cyclic variation or nonuniformity in travel speed of the toothed belt 8 occurs in the head drive mechanism in spite of uniform circular motion of the toothed pulley 7. Such nonuniformity of the travel speed is repeatedly generated at a cycle corresponding to pitches of the teeth of the toothed belt 8. As described above, the toothed belt 8 and photosensitive head 14 carry out the entirely same motion, so that a variation or nonuniformity in speed at a cycle corresponding to the pitches of the teeth likewise occurs in the photosensitive head 14, resulting in an image printed tending to have color shading formed thereon at a cycle corresponding to the pitches of the teeth.

Now, the color shading caused due to such nonuniformity of the travel speed will be described hereinafter.

Figures 3A, 3B:
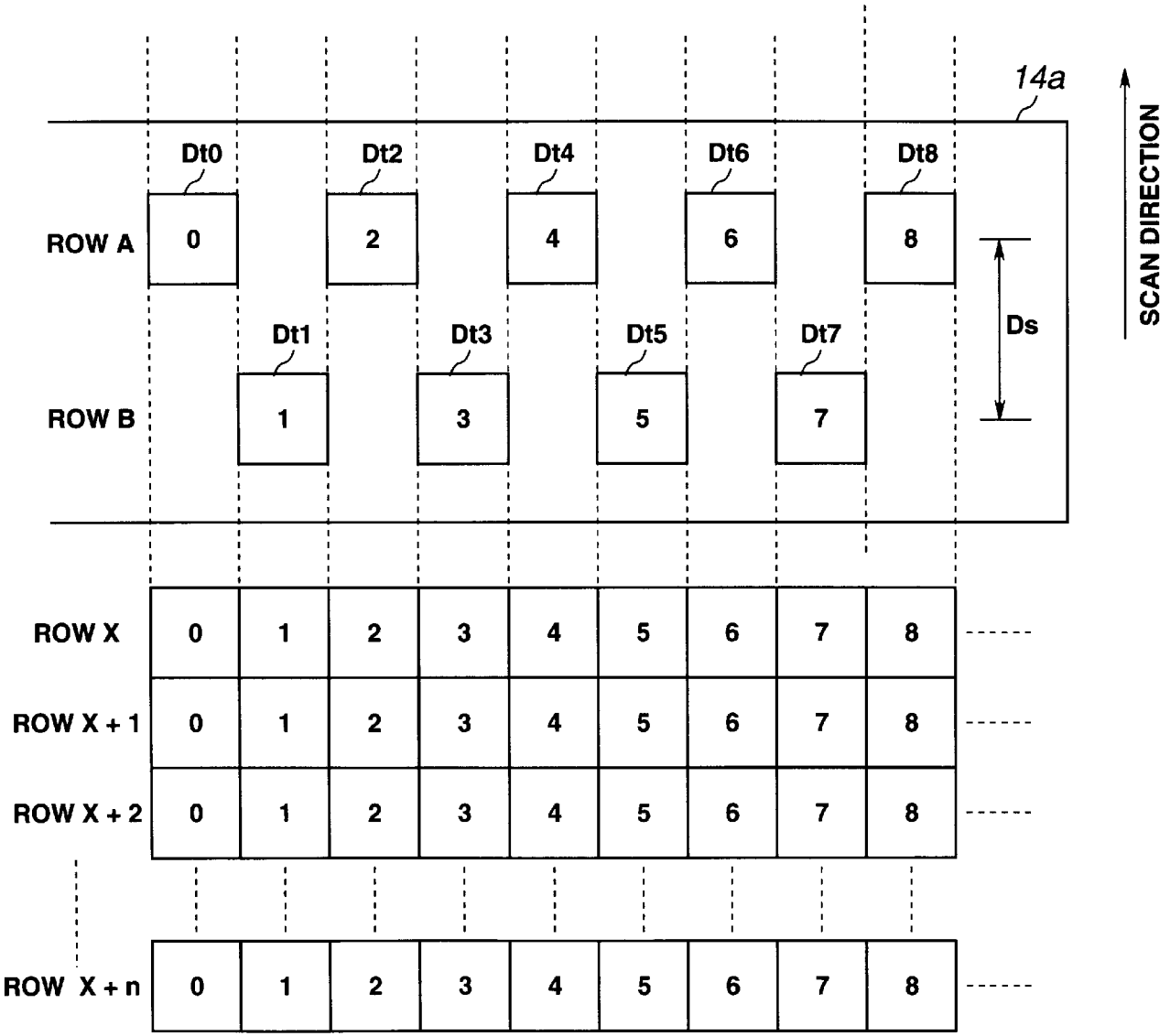
FIGS. 3A and 3B is a diagrammatic view showing a photosensitive head.

The dot block 14*a* which is formed on the photosensitive head 14 to subject the photosensitive paper to exposure is constructed as shown in FIG. 3(*a*). The dot block 14*a* includes a luminous dot group constituted of a line of a row A constituted of even luminous dots Dt0, Dt2, Dt4 . . . and a line of a row B constituted of odd luminous dots Dt1, Dt3, Dt5 . . . . Also, the rows A and B are so arranged that the luminous dots of the row A and those of the row B are offset from each other with an interval Ds being defined therebetween.

Thus, sliding of the photosensitive head 14 by means of such a drive system as shown in FIG. 1 permits a photosensitive surface to be scanned in the directions indicated at the arrows, so that an image for one row is subsequently scanned in a main scan direction of a developing paper by the rows A and B.

FIG. 3(*b*) shows a surface of a photosensitive paper exposed. For example, in a row X, cells 0, 2, 4, 6 and 8 are first exposed by luminous dots of the row A, followed by sliding of the photosensitive head 14 by a distance equal to the interval Ds. Then, cells 1, 3, 5 and 7 are exposed by luminous dots of the row B, resulting in exposure of the row X being completed.

The luminous dots each emit light depending on a drive signal fed from the luminous dot derive section (not shown). Thus, for example, the luminous dot Dt0 is allocated to exposure of cells 0 of the rows X, X+1, X+2, X+3 . . . . Then, the luminous dot Dt1 is allocated to exposure of cells 1 of the rows X, X+1, X+2, X+3 . . . after a period of time corresponding to the interval Ds elapses.

When a cyclic variation or nonuniformity in travel speed occurs due to a variation in travel speed of the photosensitive head 14, the image exposed is rendered dark at a location in which a travel speed of the photosensitive head 14 is reduced as compared with an average speed thereof and rendered light at a location in which the travel speed is higher than the average speed.

Figures 4A, 4B:
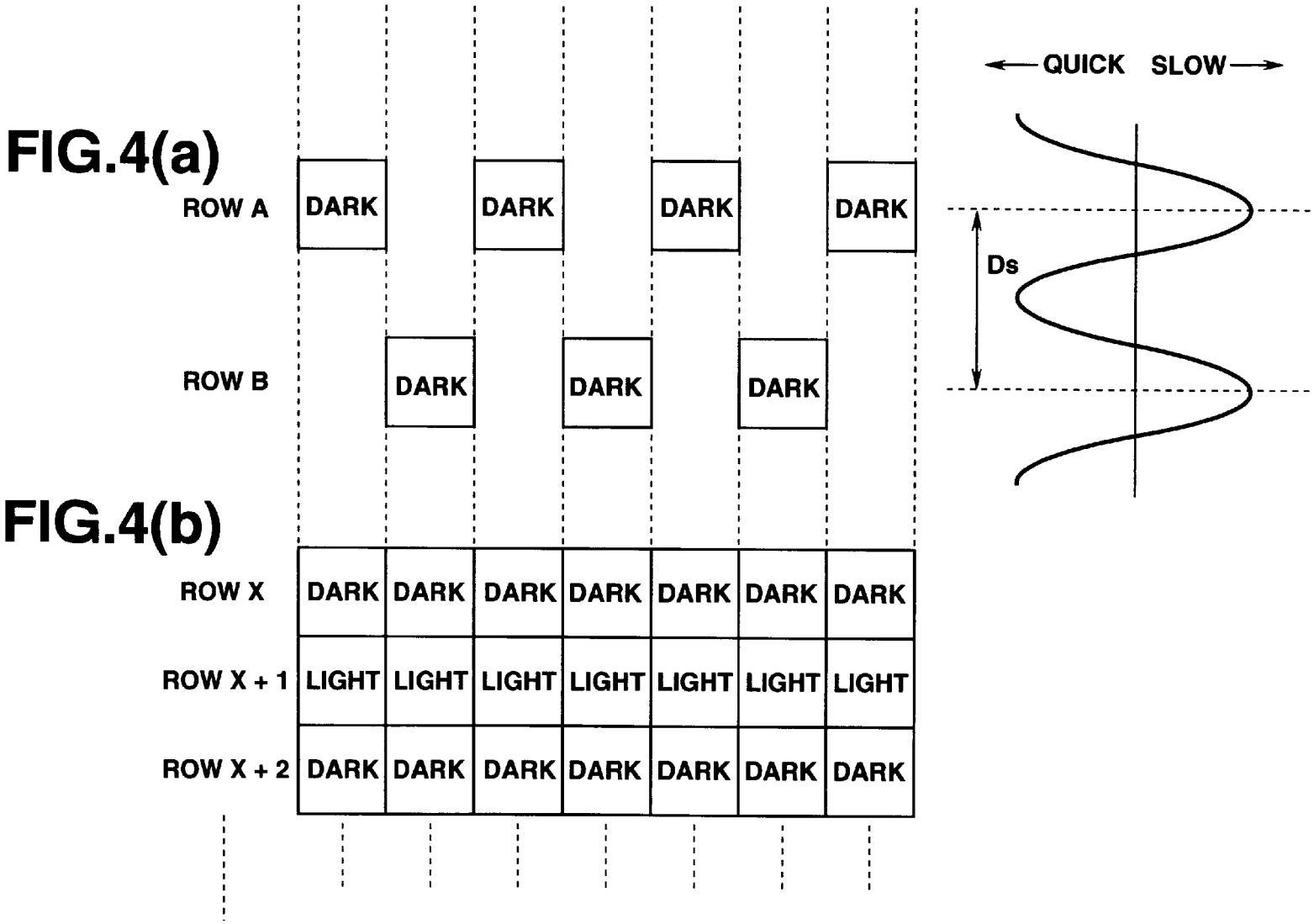
FIGS. 4A and 4B is a diagrammatic view showing generation of color shading due to a variation or nonuniformity in travel speed of a photosensitive head.

More specifically, supposing that a cycle of the above-described variation or nonuniformity in speed reduced in terms of a travel distance of the head approaches the interval Ds between the row A and the row B as shown in FIG. 4, a reduction in travel speed of the head during exposure of the row X with the luminous dots of the row A causes the cells 0, 2, 4, 6 and 8 to be dark as indicated at reference character D in FIG. 4. Then, when a travel speed of the photosensitive head 14 is likewise decreased during exposure of the row X with the luminous dots of the row B, the cells 0, 2, 4, 6 and 8 are likewise rendered dark, resulting in all the cells of the row X being dark.

In this case, the row X is thus dark and then the rows X+1 and X+2 are rendered light and dark, respectively. Thus, the dark rows and light rows alternately appear at every second interval, resulting in color shading or nonuniformity in luminance being rendered remarkable.

Figures 5A, 5B:
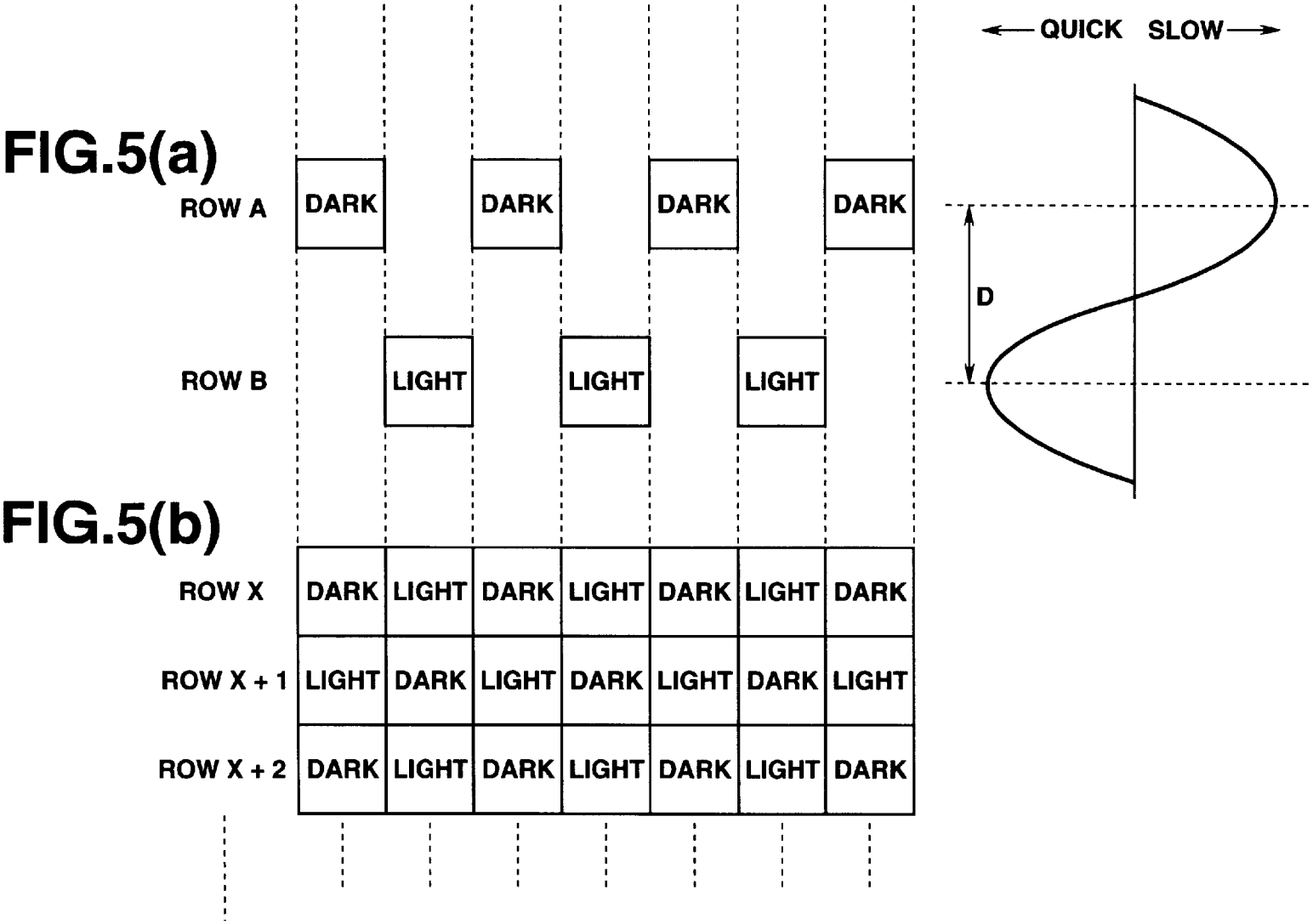
FIGS. 5A and 5B is a diagrammatic view showing prevention of generation of color shading.

In view of the disadvantage, the present invention is constructed so as to set such a variation or nonuniformity in travel speed of the photosensitive head 14 at a suitable cycle to minimize the color shading. Now, the construction of the present invention will be described with reference to FIG. 5 by way of example. As shown in FIG. 5, a cycle at which the travel speed variation occurs is set to be half as long as the interval Ds between the row A and the row B. Application of the thus-set cycle to gradation (darkness/lightness) of the rows A and D as in FIG. 4 permits the luminous dots of each of the rows X, X+1, X+2 . . . to be alternately rendered dark and light as shown in FIG. 5(*b*), so that an image plane may be permitted to have substantially uniform darkness or depth as a whole.

Figure 6:
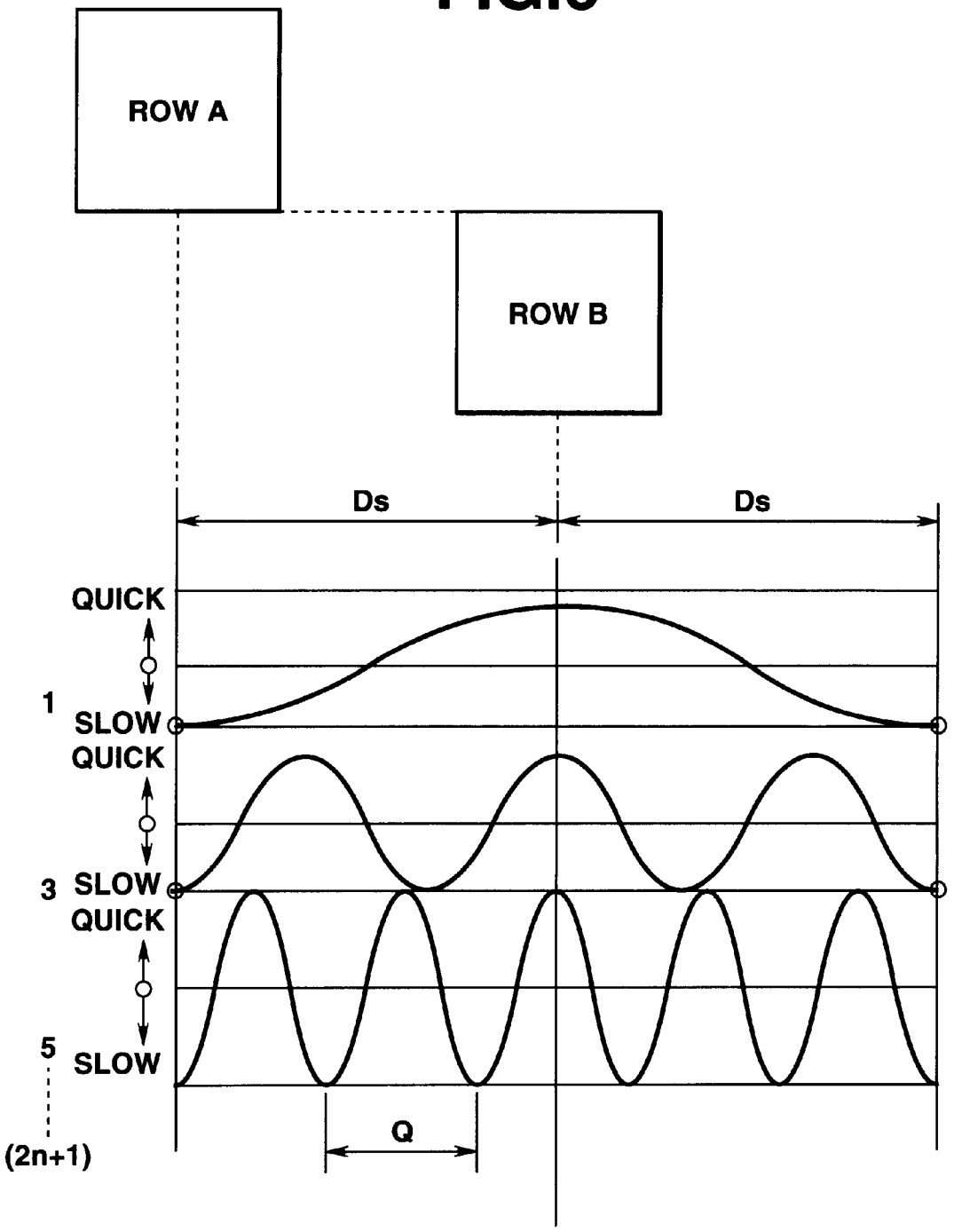
FIG. 6 is a diagrammatic view showing conditions which permit generation of color shading to be offset.
Figure 7:
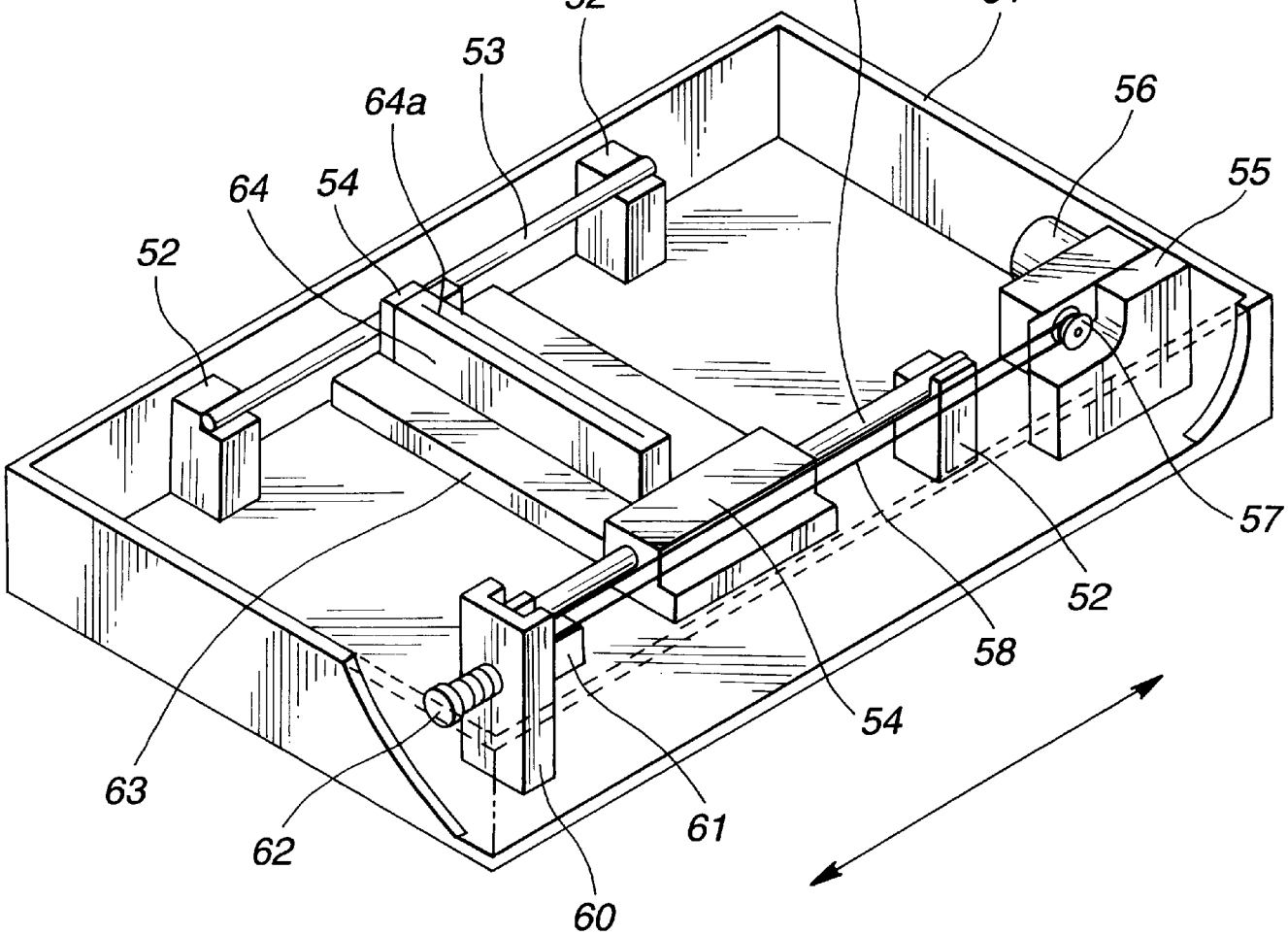
FIG.7 ( PRIOR ART )
FIG. 7 is a perspective view showing a conventional printer.
Figure 8:
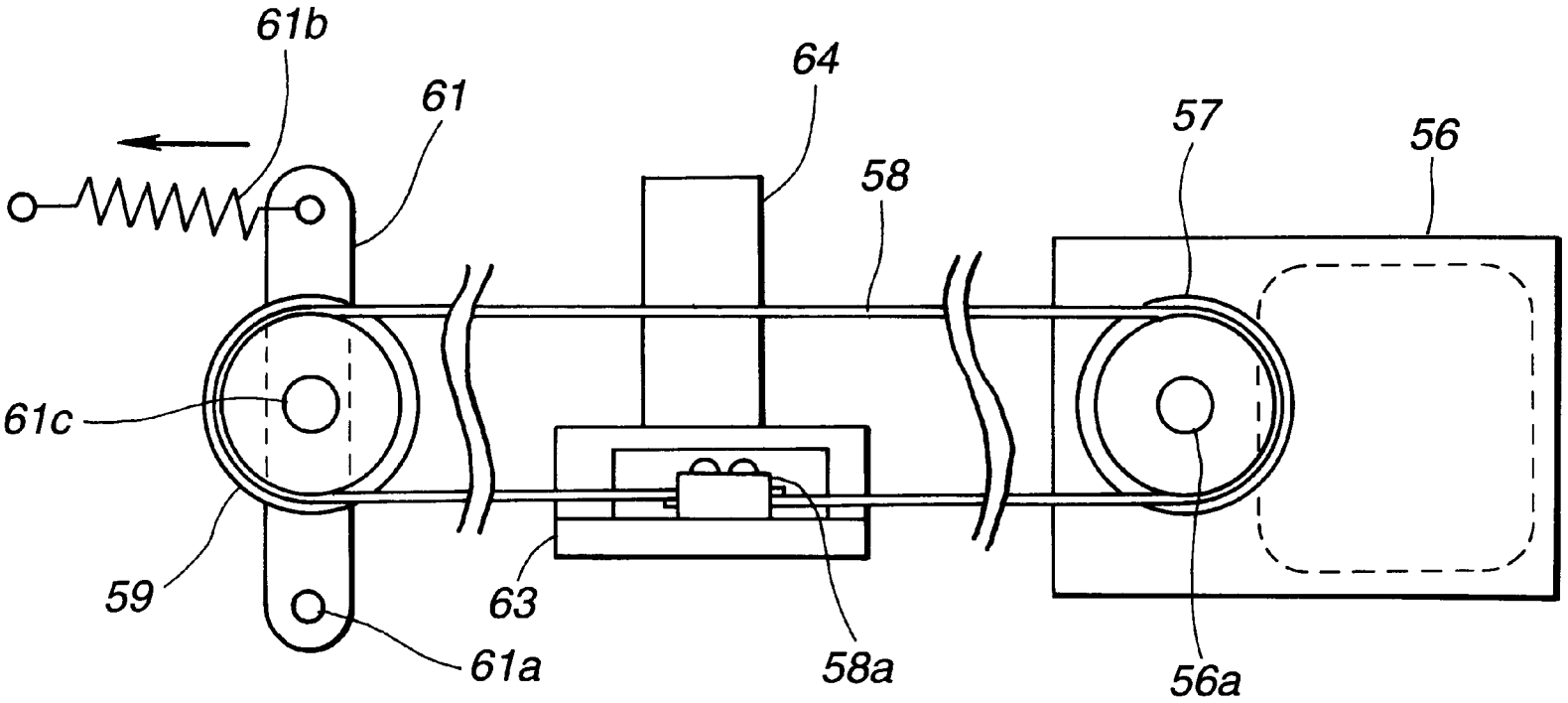
FIG.8 ( PRIOR ART )
FIG. 8 is a schematic perspective view showing a transmission system for the printer of FIG. 7.
Figure 9:
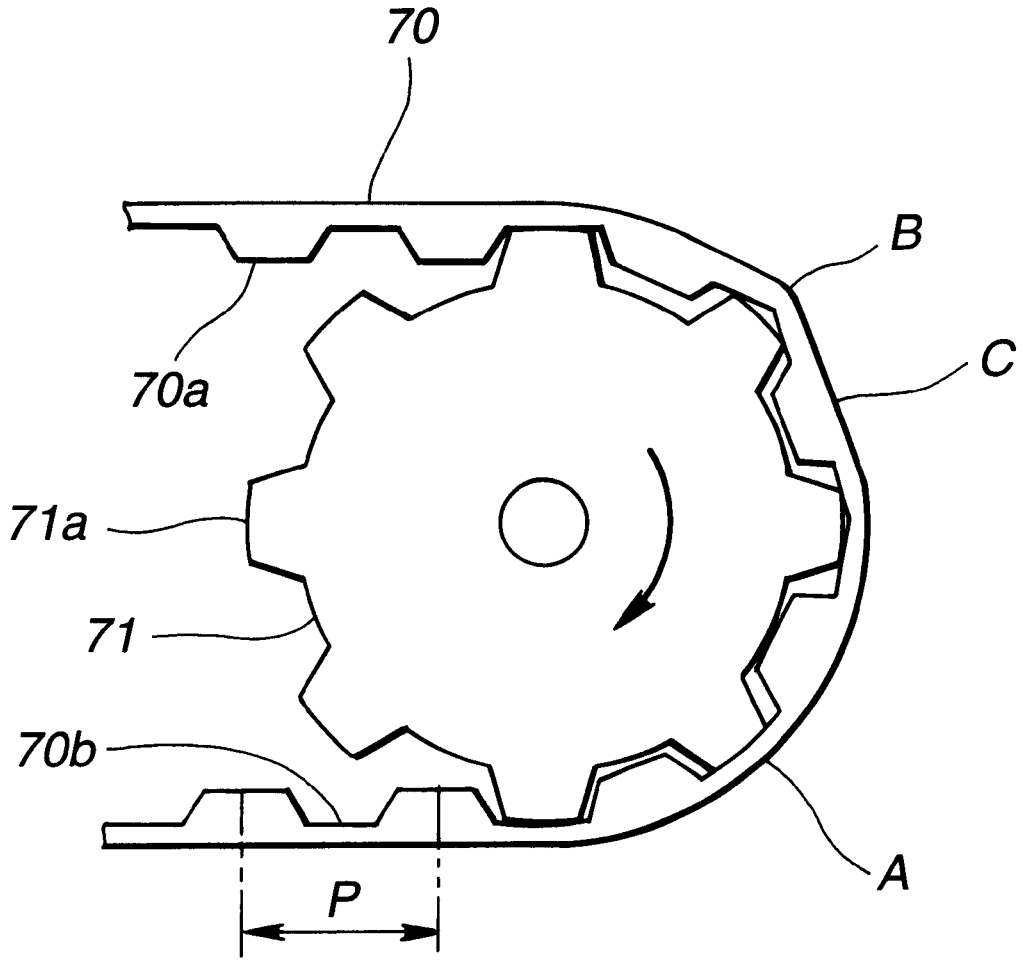
FIG. 9 is a schematic view showing generation of nonuniformity in speed of a toothed belt.

Relationship between the cycle of the speed variation which keeps color shading from occurring in the image exposed and the interval Ds between the row A and the row B is shown in FIG. 6. As noted from FIG. 6, it is required that such a speed variation odd times as long as one cycle ($2\pi$) (which is expressed by Q) is within a range two times as long as the interval Ds. When the photosensitive head 14 and toothed belt 8 are entirely identical in travel speed with each other, the cycle Q in FIG. 6 corresponds to the interval P of the teeth of the toothed belt 8 shown in FIG. 9 or a pitch of the teeth of the toothed pulley.

Thus, the transmission system is so constructed that the toothed belt 8 has tooth pitches Q=2Ds/(2n+1) reduced in terms of a relative travel distance of the photosensitive head 14, wherein n is 0 or a positive integer.

In the illustrated embodiment, the interval Ds between the row A and the row B in the luminous dots of the photosensitive head 14 may be set to be 0.5 mm and the pitch of the teeth of the toothed belt 8 may be set to be 1 mm. In the illustrated embodiment, the relative travel distance may be set to be 1 mm which is equal to the pitch of the teeth because the photosensitive head 14 and toothed belt 8 are entirely identical in travel speed with each other. Thus, the relative travel distance corresponds to the above-described expression (2n+1) wherein n is 0 (n=0), so that color shading in the image exposed may be substantially eliminated.

In the illustrated embodiment, a reduction ratio of the reduction mechanism incorporated in the motor may be set to be about thirty-four (34) and the number of teeth of the toothed pulley may be set to be 34. Such setting is suitable, because the speed variation due to eccentricity of the toothed pulley is increased in cycle.

When a variation or nonuniformity in speed of the reduction mechanism wherein gears are used for the reduction mechanism incorporated in the motor 6 cannot be ignored, the number of teeth of the reduction mechanism may be suitably set so that a cycle of a speed variation of the toothed pulley is 1/(2n+1) (n=0, 1, 2, 3 . . . ) with respect to the pitch of the toothed belt 8.

The above description has been made on the printer which is so constructed that the photosensitive head travels in the scan direction to subject an image to exposure. However, the present invention may be effectively applied to a transmission system for a printer in which a photosensitive paper is transferred while keeping the photosensitive head stationary. Also, the present invention may be likewise applied to a scanner head transfer mechanism for a scanner wherein photoreceptors for reading an image are arranged in an offset or staggered manner as in the photosensitive head and a transmission system for driving a developing paper in a printer wherein the developing paper is transferred while keeping a head stationary.

As can be seen from the foregoing, the head drive mechanism of the present invention wherein the toothed belt is incorporated in the transmission system eliminates color shading in an image due to a variation or nonuniformity in travel speed of the toothed belt.

Also, the final stage of the transmission system for transfer of the head is constituted of the toothed pulley and toothed belt rather than the pulley and wire rope in the prior art. Such construction eliminates a deterioration in workability due to use of the wire rope and that due to miniaturization of the printer. Further, the present invention facilitates transfer of the head module in the vertical direction and permits a reduction in manufacturing cost to be attained.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A head drive mechanism comprising:

a head including a plurality of recording dots arranged at predetermined intervals;

said recording dots being arranged in the form of lines spaced from each other at a predetermined interval Ds in a scan direction of a recording medium;

a drive section for driving said head relatively to said recording medium; and a transmission system for transmitting power from said drive section to said head;

said transmission system including a final transmission system constituted of a toothed pulley and a toothed belt;

said toothed belt having tooth pitches Q=2Ds/(2n+1) reduced in terms of a relative travel distance of said head, wherein n is 0 or a positive integer.

* * * * *